US009758743B2

(12) United States Patent
Knapton et al.

(10) Patent No.: US 9,758,743 B2
(45) **Date of Patent: *Sep. 12, 2017**

(54) MIXTURES OF OLEFIN-ESTER COPOLYMER WITH POLYOLEFIN AS VISCOSITY MODIFIER

(71) Applicant: The Lubrizol Corporation, Wickliffe, OH (US)

(72) Inventors: Daniel J. Knapton, Willowick, OH (US); William R. S. Barton, Belper (GB); Brett Wessler, Wickliffe, OH (US); Mark R. Baker, Midland, MI (US)

(73) Assignee: The Lubrizol Corporation, Wickliffe, OH (US)

( * ) Notice: Subject to any disclaimer, the term of this patent is extended or adjusted under 35 U.S.C. 154(b) by 171 days.

This patent is subject to a terminal disclaimer.

(21) Appl. No.: 14/376,851

(22) PCT Filed: Feb. 14, 2013

(86) PCT No.: PCT/US2013/026098

§ 371 (c)(1),
(2) Date: Aug. 6, 2014

(87) PCT Pub. No.: WO2013/123160

PCT Pub. Date: Aug. 22, 2013

(65) Prior Publication Data

US 2014/0364349 A1 Dec. 11, 2014

Related U.S. Application Data

(60) Provisional application No. 61/600,158, filed on Feb. 17, 2012.

(51) Int. Cl.

| | |
|---|---|
| ***C10M 149/00*** | (2006.01) |
| ***C10M 143/06*** | (2006.01) |
| ***C10M 157/04*** | (2006.01) |
| ***C10M 169/04*** | (2006.01) |
| *C10M 149/02* | (2006.01) |

(52) U.S. Cl.

CPC ..... *C10M 157/04* (2013.01); *C10M 169/041* (2013.01); *C10M 143/06* (2013.01); *C10M 149/02* (2013.01); *C10M 2205/022* (2013.01); *C10M 2205/024* (2013.01); *C10M 2205/026* (2013.01); *C10M 2205/028* (2013.01); *C10M 2205/0245* (2013.01); *C10M 2205/0265* (2013.01); *C10M 2205/0285* (2013.01); *C10M 2205/04* (2013.01); *C10M 2217/06* (2013.01); *C10M 2219/022* (2013.01); *C10M 2219/046* (2013.01); *C10M 2219/106* (2013.01); *C10M 2223/043* (2013.01); *C10N 2220/021* (2013.01); *C10N 2220/022* (2013.01); *C10N 2230/06* (2013.01); *C10N 2230/42* (2013.01); *C10N 2230/43* (2013.01); *C10N 2230/58* (2013.01); *C10N 2240/04* (2013.01); *C10N 2240/042* (2013.01); *C10N 2240/044* (2013.01); *C10N 2240/045* (2013.01); *C10N 2240/046* (2013.01); *C10N 2240/08* (2013.01); *C10N 2240/10* (2013.01); *C10N 2240/102* (2013.01); *C10N 2240/103* (2013.01); *C10N 2240/105* (2013.01); *C10N 2240/30* (2013.01); *C10N 2240/40* (2013.01); *C10N 2250/10* (2013.01); *C10N 2260/09* (2013.01)

(58) Field of Classification Search

CPC ..... C10M 2219/09; C10M 2217/06
USPC ..... 508/235, 284
See application file for complete search history.

(56) References Cited

U.S. PATENT DOCUMENTS

| | | | | |
|---|---|---|---|---|
| 2008/0020952 | A1* | 1/2008 | Yagishita | C10M 139/00 508/186 |
| 2011/0190182 | A1 | 8/2011 | Price et al. | |

FOREIGN PATENT DOCUMENTS

| | | | |
|---|---|---|---|
| EP | 1975222 | A1 | 10/2008 |
| GB | 1286966 | A | 8/1972 |
| WO | 2011146692 | A1 | 11/2011 |

OTHER PUBLICATIONS

Written Opinion of the Corresponding International Application No. PCT/US2013/026098 dated May 7, 2013.
Search Report of the Corresponding International Application No. PCT/US2013/026098 dated May 7, 2013.
Corresponding International Publication No. WO2013/123160 A1 Published Aug. 22, 2013.
"Ketjenlube 2300" Aug. 1, 2007 (Aug. 1, 2007), XP055061401, [retrieved on Apr. 29, 2013].
R. W. M. Wardle et al: "An in lubro' study of viscosity index improvers in end contacts", Lubrication Science, vol. 3, No. 1, Oct. 1, 1990 (Oct. 1, 1990), pp. 45-62, XP055084374, ISSN: 0954-0075, DOI: 10.1002/Is.3010030104.
Barton, et al: "Impact of Viscosity Modifiers on Gear Oil Efficiency and Durability", SAE International Journal of Fuels and Lubricants, vol. 5, No. 1, pp. 470-479, XP009173624, ISSN: 1946-3952 [retrieved on Aug. 30, 2011].

* cited by examiner

*Primary Examiner* — Vishal Vasisth
(74) *Attorney, Agent, or Firm* — Christopher D. Hilker; David M. Shold

(57) ABSTRACT

A lubricant composition of an oil of lubricating viscosity; an esterified copolymer with a backbone comprising units derived from (i) an α-olefin monomer of at least about 6 carbon atoms and (ii) an ethylenically unsaturated carboxylic acid in a mole ratio of 1:3 to 3:1; and a polymer comprising olefin monomer units of 3 to 5 carbon atoms, wherein at least 50 percent by weight of such units contain fewer than 6 carbon atoms and wherein less than 5 percent by weight of such units are ethylene monomer units; exhibits good power transfer efficiency and elastohydrodynamic film thickness.

8 Claims, No Drawings

MIXTURES OF OLEFIN-ESTER COPOLYMER WITH POLYOLEFIN AS VISCOSITY MODIFIER

This application is a 371 of PCT/US2013/026098, filed Feb. 14, 2013 which claims benefit of 61/600,158, filed Feb. 17, 2012.

BACKGROUND OF THE INVENTION

The disclosed technology relates to polymer-containing lubricant formulations useful for lubricating mechanical devices, especially those involving lubrication of gears.

U.S. Patent Application US-2011-0190182, Price et al., Aug. 4, 2011, earlier published as WO2010/014655, discloses a copolymer comprising units derived from monomers (i) an α-olefin and (ii) an ethylenically unsaturated carboxylic acid or derivatives thereof esterified with certain alcohols which may be used to provide, among other properties, improved viscosity index control to a lubricant. It may be used along with other performance additives, including, among others, (other) viscosity modifiers such as polyolefins. It may be used with an oil, which may be a synthetic lubricating oil including, among others listed, polybutylenes.

PCT Publication WO2011/146692, Nov. 24, 2011, discloses a lubricating composition containing a copolymer comprising units derived from monomers (i) an α-olefin and (ii) an ethylenically unsaturated carboxylic acid or derivatives thereof esterified and amidated with an alcohol and an aromatic amine.

A primary role of a lubricant in a mechanical device is to prevent direct metallic contact which would result in adverse friction, reduced fatigue life and rapid wear. As the viscosity of a fluid is reduced so is the film thickness, which is required for separation of moving parts. Under moderate to high load (typically 0.3 to 3.0 GPa) the mechanism of film protection is referred to as elastohydrodynamic (EHD) lubrication. EHD film thickness can be improved by the addition of polymeric materials or viscosity modifiers to a fluid. However, such additives may lead to relatively low efficiency in the power transfer between surfaces such as a gear. On the other hand, certain lubricant additives are effective at providing good efficiency through lower fluid viscosity, higher VI, lower operating temperature or low traction but may provide inadequate EHD film thickness. It is desirable to have a lubricant that provides a good combination of power transfer efficiency and EHD film thickness.

SUMMARY OF THE INVENTION

The disclosed technology provides a lubricant composition comprising (a) an oil of lubricating viscosity having a kinematic viscosity at 100° C. of less than 15 $mm^2/s$ and (b) an esterified copolymer (that is, a copolymer containing ester functionality, particularly pendant ester functionality, as further described herein) with a backbone comprising units derived from (i) an α-olefin monomer of at least 6 carbon atoms and (ii) an ethylenically unsaturated carboxylic acid or derivative thereof, wherein the mole ratio of (i) α-olefin monomer to (ii) carboxylic acid or derivative monomer is 1:3 to 3:1, said copolymer optionally containing nitrogen functionality; and (c) a polymer comprising olefin monomer units of at least 3 carbon atoms, wherein at least 50 percent by weight of such units contain fewer than 6 carbon atoms and wherein less than 5 percent by weight of the monomer units are ethylene monomer units; said polymer having a kinematic viscosity at 100° C. of at least 1000 (or at least 250, 500, or 800) $mm^2/s$; wherein the polymers (b) and (c) are present in a weight ratio (b):(c) of 1:10 to 10:1 or 1:1 to 10:1 or 6:4 to 9:1 and wherein the total amount of polymer (b) plus (c) is 3 to 60 percent by weight of the lubricant composition.

The disclosed technology also provides a method of lubricating a mechanical device such as a gear or a device containing gears, such as a hypoid gear, using the lubricant described herein, and also provides a process for preparing such a composition, as described in greater detail below.

DETAILED DESCRIPTION OF THE INVENTION

Various preferred features and embodiments will be described below by way of non-limiting illustration.

One component (a) of the disclosed technology is an oil of lubricating viscosity, also referred to as a base oil. Its kinematic viscosity will be less than 15 $mm^2/s$ (cSt) at 100° C., and in other embodiments 1-12 or 2-10 or 3-8 or 4-6 $mm^2/s$. The base oil may be selected from any of the base oils in Groups I-V of the American Petroleum Institute (API) Base Oil Interchangeability Guidelines, namely

| Base Oil Category | Sulfur (%) | | Saturates(%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | >120 |
| Group IV | All polyalphaolefins (PAOs) | | | |
| Group V | All others not included in Groups I, II, III or IV | | | |

Groups I, II and III are mineral oil base stocks. The oil of lubricating viscosity can include natural or synthetic oils and mixtures thereof. Mixture of mineral oil and synthetic oils, e.g., polyalphaolefin oils and/or polyester oils, may be used.

Natural oils include animal oils and vegetable oils (e.g. vegetable acid esters) as well as mineral lubricating oils such as liquid petroleum oils and solvent-treated or acid treated mineral lubricating oils of the paraffinic, naphthenic, or mixed paraffinic-naphthenic types. Hydrotreated or hydrocracked oils are also useful oils of lubricating viscosity. Oils of lubricating viscosity derived from coal or shale are also useful.

Synthetic oils include hydrocarbon oils and halosubstituted hydrocarbon oils such as polymerized and interpolymerized olefins and mixtures thereof, alkylbenzenes, polyphenyl, alkylated diphenyl ethers, and alkylated diphenyl sulfides and their derivatives, analogs and homologues thereof. Alkylene oxide polymers and interpolymers and derivatives thereof, and those where terminal hydroxyl groups have been modified by, e.g., esterification or etherification, are other classes of synthetic lubricating oils. Other suitable synthetic lubricating oils comprise esters of dicarboxylic acids and those made from C5 to C12 monocarboxylic acids and polyols or polyol ethers. Other synthetic lubricating oils include liquid esters of phosphorus-containing acids, polymeric tetrahydrofurans, silicon-based oils such as polyalkyl-, polyaryl-, polyalkoxy-, or polyaryloxysiloxane oils, and silicate oils.

Other synthetic oils include those produced by Fischer-Tropsch reactions, typically hydroisomerized Fischer-Tropsch hydrocarbons or waxes. In one embodiment oils may be prepared by a Fischer-Tropsch gas-to-liquid synthetic procedure as well as other gas-to-liquid oils.

Unrefined, refined and rerefined oils, either natural or synthetic (as well as mixtures thereof) of the types disclosed hereinabove can used. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Rerefined oils often are additionally processed to remove spent additives and oil breakdown products.

The amount of the oil of lubricating viscosity present is typically the balance remaining after subtracting from 100 wt % the sum of the amount of the compound of the invention and the other performance additives.

The lubricating composition may be in the form of a concentrate or a fully formulated lubricant. If the lubricating composition of the invention (comprising the additives disclosed hereinabove) is in the form of a concentrate which may be combined with additional oil to form, in whole or in part, a finished lubricant, the ratio of these additives to the oil of lubricating viscosity and/or to diluent oil include the ranges of 1:99 to 99:1 by weight, or 80:20 to 10:90 by weight.

The lubricant of the disclosed technology includes at least two polymers. (Additional polymers, beside the two described in detail, may also be present if desired.) The first polymer (b) described herein is a copolymer comprising units derived from (i) certain α-olefin monomers and (ii) an ethylenically unsaturated carboxylic acid or derivative thereof.

The α-olefin may be a linear olefin or a branched olefin or mixtures thereof. The olefin will have at least 6 carbon atoms, such as 6 to 20 or 8 to 18, or 8 to 16, or 10 to 14, or 10 to 12, or about 12. Examples of α-olefins include 1-decene, 1-undecene, 1-dodecene, 1-tridecene, 1-tetradecene, 1-pentadecene, 1-hexadecene, 1-heptadecene 1-octadecene, and mixtures thereof. An example of a useful α-olefin is 1-dodecene. The first copolymer may also contain small amounts of olefin monomers having 5 or fewer carbon atoms, but the amount of such monomers, if present, will typically be 10 weight percent or less such as 5 percent or less or 2 percent or less or 1 percent or less, such as 0.5 to 5 percent by weight.

The ethylenically unsaturated carboxylic acid or derivative thereof may be an acid or anhydride or one or more derivatives thereof. In particular, the derivatives may include esters or anhydride: the acid may be, for instance, partially or completely esterified. If it is partially esterified, other functional groups that may be present include acids, salts, imides, or amides. One type of derivative is a salt. Suitable salts include alkali metal and alkaline earth metal salts, such as lithium, sodium, potassium, magnesium, calcium, or mixtures thereof.

The unsaturated carboxylic acid or derivatives thereof include cis-cinnamic acid, trans-cinnamic acid, acrylic acid, methyl acrylate, methacrylic acid, maleic acid or anhydride, fumaric acid, itaconic acid or anhydride or mixtures thereof, or substituted equivalents thereof. More specific examples include itaconic anhydride, maleic anhydride, methyl maleic anhydride, ethyl maleic anhydride, dimethyl maleic anhydride, and (meth)acrylic acid. In one embodiment the ethylenically unsaturated carboxylic acid or derivatives thereof includes maleic anhydride or derivatives thereof.

The copolymer is more fully described in U.S. Publication 2011-0190182. For example, the copolymer of the invention prepared by the reaction of monomers (i) an α-olefin and (ii) an ethylenically unsaturated carboxylic acid or derivatives thereof are described in paragraphs [0184]-[0185]. The copolymer may, in one embodiment, be a copolymer derived from 1-dodecene and maleic anhydride. Subsequent esterification and optional amidation are described in greater detail in paragraphs [0186]-[0193] of that publication.

In one embodiment, the backbone chain, in addition to the α-olefin monomer units and carboxylic monomer units, may further include other monomer-derived units capable of polymerizing therewith. These additional units may be randomly incorporated throughout the copolymer backbone or may be in the form of a block or blocks. The copolymer may comprise 0 to 30 mole %, or 0 to 20 mole % or 0 to 10 mole %, or 1 to 10 mole % of such optional units. Examples of such units include those derived from a vinyl aromatic monomer such as styrene or a (meth)acrylate. As used herein, the expression (meth)acrylate, and related terms, is intended to signify both the acrylate and/or the methacrylate.

The copolymer may be obtained or obtainable by a process comprising (1) reacting monomers (i) an α-olefin and (ii) an ethylenically unsaturated carboxylic acid or derivatives thereof to form a copolymer; then (2) reacting the copolymer thus formed with an alcohol to form an esterified copolymer; and optionally reacting the product with an aromatic amine, or a non-aromatic amine, to form a copolymer that is esterified and optionally amidated (or otherwise nitrogen functionalized, such as imidated (formation of an imide) or aminated (a general term to refer to reaction with an amine, which may include formation of the amine salt)). Reaction with alcohol and amine may be conducted in any order.

In an alternative process, the polymer may be obtained or obtainable by a process comprising (1) reaction monomers (i) an α-olefin and (ii) an ethylenically unsaturated carboxylic ester monomer to form a copolymer. Optionally, some unesterified carboxylic monomer may also be present. The polymer thus formed will be an esterified copolymer and no separate reaction with an alcohol is required, although further reaction with alcohol may be performed if desired, to effect, for instance, a transesterification or to further esterify any unesterified acid functionality. Optionally, the product may be further reacted with an amine, which may either react with any unesterified carboxylic functionality or which may replace some of the original ester functionality with nitrogen functionality.

In one embodiment the amine is present in an amount sufficient to provide the copolymer of the invention with 0.01 wt % to 1.5 wt % (or 0.05 wt % to 0.75 wt %, or 0.075 wt % to 0.25 wt %) of nitrogen. In one embodiment the amine may be present in an amount such that there are 1 mol % to 20 mol %, or 3 mol % to 10 mol % of amine per monomer derived from the unsaturated acid monomers. The amount of amine which is reacted may be equal, on an equivalent basis, to the amount of unreacted carboxylic acid functionality remaining on the polymer.

The polymerization process to form the product of step (1) above may be through solution free-radical polymerization or by other processes known in the art. In the polymer prepared by step (1), for example the mole ratio of (i) α-olefin and (ii) ethylenically unsaturated carboxylic acid or derivative may be 1:3 to 3:1, or 1:2 to 2:1, 0.8:1 to 1:1, or about 1:1.

The polymer from step (1) above, prior to amidation or esterification, may be described in terms of its weight average molecular weight. Typically the weight average molecular weight is measured on the final esterified and (optionally) amidated copolymer. The weight average molecular weight may be 5000 to 35,000, or 5000 to 30,000, or 5000 to 25,000, or 10,000 to 17,000, or 5000 to 10,000, or 12,000 to 18,000, or 9000 to 15,000, or 15,000 to 20,000, or 8000 to 21,000. In one embodiment the molecular weight is 5000 to 30,000 or 5000 to 25,000 after esterification and optional reaction with amine.

In one embodiment, a copolymer backbone may be prepared by reacting 1 mole (relative amount) of maleic anhydride, and Y moles (defined below) of 1-dodecene in the presence of an aromatic solvent. A tert-butyl peroxy-2-ethylhexanoate initiator may be used, along with optionally n-dodecyl mercaptan (chain transfer agent, CTA), in a solvent such as toluene, xylene, or a petroleum fraction at elevated temperature (e.g., 105° C.). In various embodiments, the number of moles, Y, of 1-dodecene may vary from 0.80 to 1.0.

Free radical initiators are known. They include peroxy compounds, peroxides, hydroperoxides, and azo compounds and other suitable examples as described in J. Brandrup and E. H. Immergut, Editor, "Polymer Handbook", 2nd edition, John Wiley and Sons, New York (1975), pages II-1 to II-40. Commercially available free radical initiators include classes of compound sold under the trademark Trigonox®-21 from Akzo Nobel.

Chain transfer agents are also known to the person skilled in the art. The chain transfer agent may be added to a polymerization as a means of controlling the molecular weight of the polymer. The chain transfer agent may include a sulfur-containing chain transfer agent such as n- and t-dodecylmercaptan, 2-mercaptoethanol, methyl-3-mercaptopropionate. Terpenes can also be used. Typically the chain transfer agent may be n- and t-dodecylmercaptan.

The polymer from step (1) will be esterified, typically by reaction of at least a portion of the acid (or equivalent) groups thereof with an alcohol. The alcohol may be a single alcohol or a mixture of alcohols. The alcohol or alcohols may be a linear or branched alcohol, a cyclic or acyclic alcohol, or a combination of features thereof. The esterified groups may be derivable from linear or branched alcohols. The alcohol may have 1 to 150, or 4 to 50, 2 to 20, 8 to 20 (such as 4 to 20, or 4 to 16, or 8 to 12) carbon atoms. Typically, the number of carbon atoms is sufficient to make the copolymer of the invention dispersible or soluble in oil. Alternatively, the ester functionality may be introduced by incorporating the appropriate ester monomer into the polymerization reaction.

In various embodiments the alcohol may be a primary, secondary, or tertiary alcohol, and in some embodiments it is a branched primary alcohol. In certain embodiments the branching may be at the β- or higher position, or at the β position and, in some embodiments, there may also be present a linear primary alcohol. The alcohol may have at least 8 (or at least 12, or at least 16, or at least 18 or at least 20) carbon atoms. The number of carbon atoms in such branched alcohols may range from 8 to 60, or 10 to 60, or 12 to 60, or at least 12 to 60, or at least 16 to 30. In one embodiment the branched alcohol may be a Guerbet alcohol, or mixtures thereof. Guerbet alcohols typically have carbon chains with branching at the β-position. The Guerbet alcohols may contain, for instance, 10 to 60, or 12 to 60, or 16 to 40 carbon atoms. Methods to prepare Guerbet alcohols are disclosed in U.S. Pat. No. 4,767,815 (see column 5, line 39 to column 6, line 32). Examples of suitable primary alcohol branched at the β- or higher position include 2-ethylhexanol, 2-butyloctanol, 2-hexyldecanol, 2-octyldodecanol, 2-decyltetradecanol, and mixtures thereof.

Also, the alcohol may be a fatty alcohol of various chain lengths (typically containing 6 to 20, or 8 to 18, or 10 to 15, or 12 to 18, or 16 to 18 carbon atoms). Fatty alcohols include Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann. In one embodiment the alcohol comprises a mixture of (i) a Guerbet alcohol and (ii) a linear alcohol other than a Guerbet alcohol. The other alcohol may be a fatty alcohol described above.

In one embodiment, a mixture of alcohols may be used comprising a primary alcohol that is branched at the β- or higher position and a linear primary alcohol. In another embodiment the mixture of alcohols may comprise (i) a mixture of 50, or 70, or 80 to 95 mole percent of one or more alcohols having 8 to 10 carbon atoms, and 5 to 50, or to 30, or to 20 mole percent of one or more alcohols having 12 to 18 or 14 to 18 or 16 to 18 carbon atoms. There may additionally be (ii) 0.01 to 5 mole percent, or 0.1 to 3 mole percent, of an alcohol having 5 or fewer carbon atoms, such as 1 to 5, or to 4, or to 3, or to 2 carbon atoms, or 1 carbon atom.

The copolymer of the invention may be esterified with an alcohol as described above. The esterification reaction of the alcohol with the ethylenically unsaturated carboxylic acid or derivatives is within the abilities of the skilled person; a brief outline of a possible route is outlined below.

An amount of copolymer containing 1 mole (relative amount) of carboxy groups is heated to, e.g., 110° C. One mole of alcohol (relative amount, i.e., one mole of alcohol per mole of carboxy groups) may be added at this time. If the ultimate amount of the alcohol (which may be, e.g., a primary alcohol branched at the β- or higher position) is greater than one mole, in one embodiment, only one mole is added at this point. Conversely, if less than one mole of a first alcohol (e.g., a primary alcohol branched at the β- or higher position) is to be reacted, a sufficient amount of a second alcohol (e.g., a linear alcohol) may be provided to provide a total of one mole equivalent of alcohol. If desired, toward the end of the reaction, particularly if the alcohol(s) employed are relatively higher molecular weight, a lower molecular weight alcohol such as butanol may be added to esterify some or all remaining acid functionality. Catalytic amounts of an acid such as methane sulphonic acid may be employed for the esterification, and excess of such material may be neutralized, if desired, at the end of the reaction with a base such as sodium hydroxide.

In certain embodiments, the mole ratios of branched alcohol to linear alcohol may be 0.05:0.95, or 0.1:0.9, or 0.2:0.8, or 0.3:0.7, or 0.5:0.5, or 0.75:0.25, or 1:0. Suitable branched alcohols include 2-hexyldecanol, 2-ethylhexanol, and 2-octyldodecanol. A suitable linear alcohol is a $C_{8-10}$ mixture commercially available as Alfol® 810.

The polymer thus prepared may be further reacted with one or more amines (e.g., aminated, amidated, or imidated). The amine may include an aromatic amine or a non-aromatic amine. The aromatic amine may be a monoamine or a polyamine. The aromatic amine may include aniline, nitroaniline, aminocarbazole, aminoalkylphenothiazines, phenoxyphenylamine (also known as phenoxyaniline), 4-aminodiphenylamine (ADPA), coupled 4-aminodiphenylamine, or mixtures thereof. In one embodiment the aromatic amine is not a heterocycle. The aromatic amine may include aniline, nitroaniline, 4-aminodiphenylamine (ADPA), and coupling products of ADPA.

Coupled products of ADPA may be represented by the formula (1):

Formula (1)

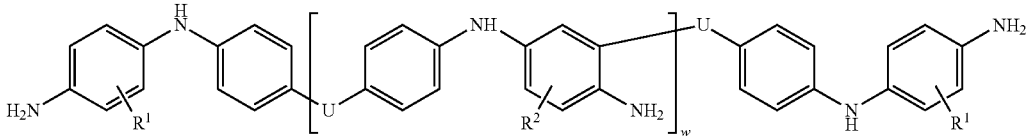

wherein independently each variable, $R^1$ may be hydrogen or a $C_{1-5}$ alkyl group (typically hydrogen);

$R^2$ may be hydrogen or a $C_{1-5}$ alkyl group (typically hydrogen);

U may be an aliphatic, alicyclic or aromatic group, with the proviso that when U is aliphatic, the aliphatic group may be linear or branched alkylene group containing 1 to 5, or 1 to 2 carbon atoms; and w may be 0 to 9 or 0 to 3 or 0 to 1 (typically 0)

In one embodiment the aromatic amine may have at least 3 or aromatic groups. Examples of an amine having at least 3 aromatic groups may be represented by any of the following Formulas (2) and/or (3):

Formula (2)

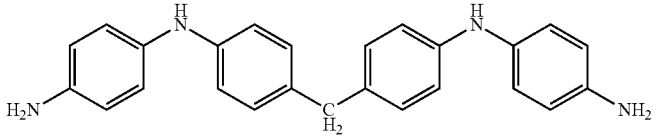

Formula (3)

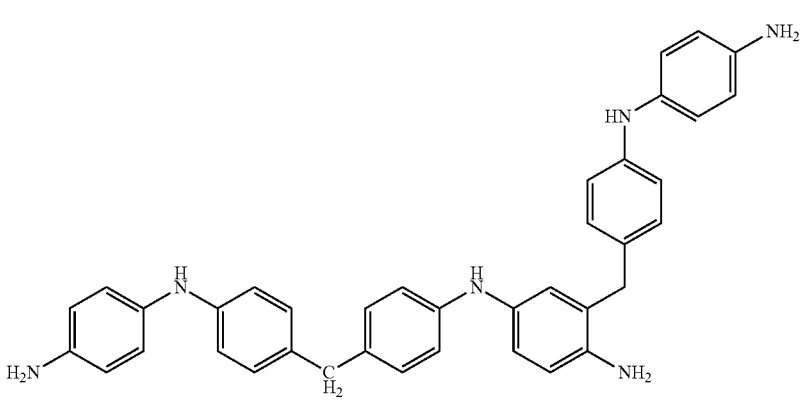

A person skilled in the art will appreciate that compounds of Formulas (2) and (3) may also cyclize to form acridine derivatives in which one or more heterocyclic groups may be present, e.g.,

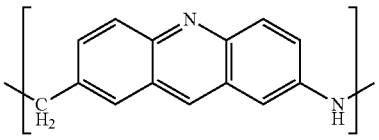

The coupled aromatic amine (such as coupled ADPA) may be prepared by reacting the aromatic amine with an aldehyde such as formaldehyde or benzaldehyde. The process may be carried out at a reaction temperature in the range of 40° C. to 180° C., or 50° C. to 170° C. and may or may not be carried out in the presence of a solvent such as diluent oil, benzene, t-butyl benzene, toluene, xylene, chlorobenzene, hexane, tetrahydrofuran, water, or mixtures thereof. Suitable amines and their preparation and their reaction with polymers are disclosed in greater detail in WO2011/146692; see in particular paragraphs [0067]-[0094].

The aromatic amine may also be or be derived from a dye intermediate containing multiple aromatic rings linked by, for example, an amide structure. Examples include materials of the general Formula (4):

Formula (4)

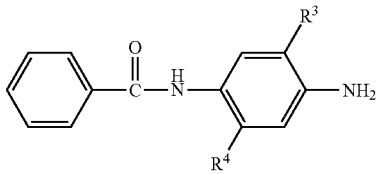

and isomeric variations thereof, where $R^3$ and $R^4$ are independently alkyl or alkoxy groups such as methyl, methoxy, or ethoxy. In one instance, $R^4$ and $R^3$ are both —$OCH_3$ and the material is known as Fast Blue RR [CAS Number 6268-05-9]. The orientation of the linking amido group may be reversed, to —NR—C(O)—. In another instance, $R^4$ is —$OCH_3$ and $R^3$ is —$CH_3$, and the material is known as Fast Violet B [99-21-8]. When both $R^3$ and $R^4$ are ethoxy, the material is Fast Blue BB [120-00-3]. U.S. Pat. No. 5,744,429 discloses other capping amine compounds, particularly aminoalkylphenothiazines. N-aromatic substituted acid amide compounds, such as those disclosed in U.S. Patent Application 2003/0030033 A1, may also be used. Suitable amines include those in which the amine nitrogen is a substituent on an aromatic carbocyclic compound, that is, the nitrogen is not $sp^2$ hybridized within an aromatic ring.

In one embodiment the copolymer is reacted, or is further reacted, with a nonaromatic amine, or mixtures thereof. In certain embodiments the amine, whether aromatic or non-aromatic, may be introduced as an amine-containing monomer by copolymerization or by grafting or, alternatively, introduced as a nitrogen-containing monomer, which may be seen as a condensation product of an amine. The amine (or monomer) may include non-aromatic materials such as N,N-dimethylacrylamide, N-vinyl carbonamides (such as N-vinyl-formamide, N-vinylacetamide, N-vinylpropionamides, N-vinylhydroxyacetamide), N-vinyl imidazole, N-vinyl pyrrolidinone, N-vinyl caprolactam, dimethylaminoethyl acrylate, dimethylaminoethyl methacrylate, dimethylamino-butylacrylamide, dimethylaminopropyl methacrylate, dimethylaminopropylacrylamide, dimethylaminopropylmethacrylamide, dimethylaminoethyl-acrylamide, or an aromatic material such as vinylpyridine, or mixtures thereof.

In one embodiment the imidazolidinones, cyclic carbamates or pyrrolidinones may be derived from a compound of general structure:

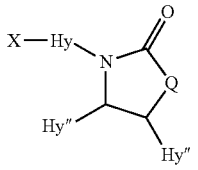

where X=—OH or —$NH_2$; Hy" is hydrogen, or a hydrocarbyl group (typically alkyl, or $C_{1-4}$-, or $C_2$-alkyl); Hy is a hydrocarbylene group (typically alkylene, or $C_{1-4}$-, or $C_2$-alkylene); Q is >NH, >NR, >$CH_2$, >CHR, >$CR_2$, or —O— (typically >NH, or >NR) and R is $C_{1-4}$ alkyl.

In one embodiment, the imidazolidinone includes 1-(2-amino-ethyl)imidazolidin-2-one (may also be called aminoethylethyleneurea), 1-(3-amino-propyl)imidazolidin-2-one, 1-(2-hydroxy-ethyl)-imidazolidin-2-one, 1-(3-amino-propyl)pyrrolidin-2-one, 1-(3-amino-ethyl)-pyrrolidin-2-one, or mixtures thereof.

In one embodiment the amine may contain additional functionality, and may be, for instance, an amine-substituted amide such as acetamide or an amine-substituted ester, some of which may be represented by the general structures, respectively:

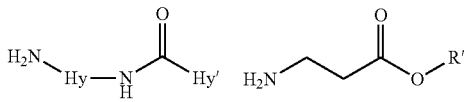

where Hy is a hydrocarbylene group (typically alkylene, or C1-4-, or C2-alkylene); and Hy' is a hydrocarbyl group (typically alkyl, or C1-4-alkyl, or methyl); and where R' is an alkyl group having 1 to 30, or 6 to 20 carbon atoms. Examples of suitable acetamides include N-(2-amino-ethyl)-acetamide and N-(2-amino-propyl)-acetamide. Examples of suitable esters include β-alanine octyl ester, β-alanine decyl ester, β-alanine 2-ethylhexyl ester, β-alanine dodecyl ester, β-alanine tetradecyl ester, and β-alanine hexadecyl ester.

The nitrogen-containing group may be derived from a primary or secondary amine, such as an aliphatic amine, aromatic amine, aliphatic polyamine, aromatic polyamine, polyaromatic polyamine, or combination thereof. If a polyamine is employed, it may have one or more than one condensable nitrogen group. If more than one condensable nitrogen group is present, its concentration and the reaction conditions may be carefully controlled to avoid undesirable gelation, as is understood by those skilled in the art.

In one embodiment, the nitrogen containing group may be derived from an aliphatic amine, such as a C1-C30 or C1-C24 aliphatic amine. Examples of suitable aliphatic amines include aliphatic monoamines and diamines, which may be linear or cyclic. Examples of suitable primary amines include methylamine, ethylamine, propylamine, butylamine, pentylamine, hexylamine, heptylamine, octylamine, decylamine, dodecylamine, tetradecylamine, hexadecylamine octadecylamine, oleylamine, dimethylaminopropylamine, diethylaminopropylamine, dibutylaminopropylamine, dimethylaminoethylamine, diethylaminoethylamine, and dibutylaminoethylamine. Examples of suitable secondary amines include dimethylamine, diethylamine, dipropylamine, dibutylamine, diamylamine, dihexylamine, diheptylamine, methylethylamine, ethylbutylamine, diethylhexylamine, and ethylamylamine. The secondary amines may be cyclic amines such as aminoethylmorpholine, aminopropylmorpholine, 1-(2-aminoethyl)pyrrolidone, piperidine, 1-(2-aminoethyl)piperidine, piperazine and morpholine. Examples of suitable aliphatic polyamines include tetraethylene pentamine, pentaethylenehexamine, diethylenetriamine, triethylenetetramine, and polyethyleneimine.

Alkanolamines, such as tertiary alkanolamines, i.e., N,N-di-(lower alkyl)amino alkanolamines, may be used as alcohols in the preparation of the esterified copolymers. Their use can permit incorporation of nitrogen functionality into the ester-containing copolymer without the necessity for a separate condensation reaction with an amine. Examples of alkanolamines include N,N-dimethylethanolamine, N,N-diethylethanolamine, 5-diethylamino-2-pentanol, and combinations thereof.

In one embodiment, the amine component of the copolymer further includes an amine having at least two N—H groups capable of condensing with the carboxylic functionality of the copolymer. This material may be referred to as a "linking amine" as it can be employed to link together two of the copolymers containing the carboxylic acid functionality. It has been observed that higher molecular weight materials may provide improved performance, and this is one method to increase the material's molecular weight. The linking amine can be either an aliphatic amine or an aromatic amine; if it is an aromatic amine, it is considered to be in addition to and a distinct element from the aromatic amine described above, which typically will have only one condensable or reactive NH group, in order to avoid excessive crosslinking of the copolymer chains. Examples of linking amines include ethylenediamine, phenylenediamine, and 2,4-diaminotoluene; others include propylenediamine, hexamethylenediamine, and other ω-polymethylenediamines. The amount of reactive functionality on such a linking amine can be reduced, if desired, by reaction with less than a stoichiometric amount of a blocking material such as a hydrocarbyl-substituted succinic anhydride.

The copolymer of the invention may be reacted with an amine, as described above, in a manner that will be well known to those skilled in the art. As an example, an esterified copolymer from above may be reacted with an amine in an amount to provide the esterified copolymer with a weight percent nitrogen content of, e.g., 0.01 to 1.5 percent, or 0.05 to 1 percent, or 0.05 to 0.75, or 0.05 to 0.4, or 0.075 to 0.25, or 0.1 to 0.4 percent. In certain embodiments, 0.1 to 25 percent of the carboxylic acid functionalites of the units derived from the ethylenically unsaturated carboxylic acid monomer are at least one of aminated, amidated, and imidated with a nitrogen containing compound, e.g., an amine. In certain embodiments the amine component may be a mixture of amines, such as 1-(2-aminoethyl)-imidazolidin-2-one and ADPA; 4-(3-aminopropyl) morpholine and ADPA; 3-(dimethylamino)-1-propylamine and ADPA; N-phenyl-p-phenylenediamine and ADPA; N-(3-Aminopropyl)-2-pyrrolidinone and ADPA; Aminoethyl acetamide and ADPA; β-alanine methyl ester and ADPA; or 1-(3-aminopropyl) imidazole and ADPA. Exemplary ratios of the first-identified amine and the ADPA may be 10:1 to 1:10, and in specific instances 10:1, 4:1, 3:1, 1:1, 1:3, 1:4, and 1:10. Ratios within these ranges may be used generally for the any optional non-aromatic amine and any aromatic amine.

The amount of the polymer (b) in a lubricant may be from 1.5 or from 2 or from 5 or from 10 percent up to 55 or to 50 or to 45 or to 40 percent by weight.

Another component in the presently disclosed lubricant is a polymer (c) comprising olefin monomer units of at least 3 carbon atoms, wherein at least 50 percent by weight of such units contain fewer than 6 carbon atoms and wherein less than 5 percent by weight of such units are ethylene monomer units. In one embodiment this polymer may comprise at least 80 percent by weight, or at least 90 percent or 95 or 98 percent by weight of olefin monomer units of 3, 4, and/or 5 carbon atoms. In one embodiment this polymer will consist essentially of olefin monomer units of 3, 4, and/or 5 carbon atoms. The olefin monomers may consist essentially of butene units, and in one embodiment, isobutene units. In one embodiment this polymer does not contain ethylene monomer units, that is, it is not an ethylene copolymer. Also, this polymer will typically contain no, or at most a small amount, of acid functionality, which feature can differentiate this polymer from the acid-containing polymer described above. Thus, carboxylic acid groups, if any, may comprise 0 to 5 mole percent of the polymer, or 0 to 2 or 0 to 1 or 0 to 0.1 or 0.001 to 0.1 mole percent. This polymer may be polyisobutylene.

The polymer (c) will in some embodiments have a kinematic viscosity at 100° C. of at least about 250, 500, 800, or 1000 $mm^2/s$ or at least 2000 $mm^2/s$, which feature will distinguish it from similar materials of much lower viscosity that are sometimes used as base oils. The polymer, and in particular the polyisobutylene, may have a number average molecular weight of 1000 to 5000, or 1500 to 3000, or 1000 to 3000, or 1800 to 2500, or about 2000. In some embodiments its Mn may be as low as 800 or 850. Its polydispersity (Mw/Mn) may be in the range of 2.5 to 4 or 3 to 3.5. It may be prepared by known methods by polymerization of (typically) isobutene using an $AlCl_3$ or $BF_3$ catalyst or by other known methods.

In certain embodiments, the amount of polymer (c) in a lubricant of the disclosed technology may be 1 to 20 weight percent, or 2 to 16, or 3 or 4 to 12 percent.

The mixture of polymers (b) and (c) within a lubricant formulation may be prepared by separately adding the polymers, neat or in separate oil dilutions, in amounts to prepare the desired formulation. Alternatively, the mixture of polymers may be prepared as a concentrate, optionally containing other additive components and optionally an appropriate amount of diluent oil, as described above.

Other additives may also be present in the lubricant composition. The performance additives, other than the disclosed polymers, may include at least one of metal deactivators, detergents, dispersants, additional viscosity index improvers (that is, one or more known polymeric viscosity index improvers in addition to polymer (b) and polymer (c) described herein), friction modifiers, corrosion inhibitors, antiwear agents, extreme pressure agents, antiscuffing agents, antioxidants, foam inhibitors, demulsifiers, pour point depressants, seal swelling agents, and mixtures thereof. Typically, the fully-formulated lubricating composition will contain one or more of these performance additives. (Treat rates, as listed, are oil-free amounts unless otherwise indicated.)

Exemplary dispersants are often known as ashless-type dispersants because, prior to mixing in a lubricating oil composition, they do not contain ash-forming metals and they do not normally contribute any ash forming metals when added to a lubricant and polymeric dispersants. Ashless type dispersants are characterized by a polar group attached to a relatively high molecular weight hydrocarbon chain. Typical ashless dispersants include succinimides, phosphonates, and combinations thereof.

Exemplary succinimides include N-substituted long chain alkenyl succinimides. Examples of N-substituted long chain alkenyl succinimides include poly(C3-C6 alkylene) succinimides, such as polyisobutylene succinimides, with a number average molecular weight of the polyisobutylene substituent in the range 350 to 5000, or 500 to 3000, or 1000-2500, or from 1300 to 2500.

Exemplary conventional and high vinylidine polyisobutylenes which may be used in forming the succinimide dispersant are disclosed, for example, in U.S. Pat. Nos. 3,215,707; 3,231,587; 3,515,669; 3,579,450; 3,912,764; 4,605,808; 4,152,499; 5,071,919; 5,137,980; 5,286,823; 5,254,649. Ethylene/alpha olefin copolymers which may be used in forming the succinimide dispersant are disclosed, for example, in U.S. Pat. Nos. 5,498,809; 5,663,130; 5,705,577; 5,814,715; 6,022,929; and 6,030,930.

Other exemplary dispersants can be derived from polyisobutylene, an amine, and zinc oxide to form a polyisobutylene succinimide complex with zinc.

Another class of ashless dispersant is acylated polyalkylene polyamines of the type described in U.S. Pat. No. 5,330,667.

Another class of ashless dispersants is Mannich bases. Mannich dispersants are the reaction products of alkyl phenols with aldehydes (especially formaldehyde) and amines (especially polyalkylene polyamines). The alkyl group typically contains at least 30 carbon atoms.

Various methods for the preparation of succinimide dispersants are known. For example, a succinimide dispersant can be produced by reaction of a C3-C6 polyalkylene (e.g., polypropylene, polyisobutylene, polypentylene, polyhexylene) or derivative thereof (e.g., a chlorinated derivative) with an or α,β unsaturated mono- or dicarboxylic acid or anhydride thereof (such as maleic anhydride) to produce an acylated C3-C6 polyalkylene compound, which is reacted with an amine, such as a primary amine or a polyamine, such as a polyethylene amine, to produce the dispersant.

Some of the following references are directed toward making an acylated C3-C6 polyalkylene compound suited to use in forming succinimide dispersants while others disclose the making of a succinimide dispersant itself. Two-step methods are described, for example, in U.S. Pat. Nos. 3,087,936; 3,172,892; and 3,272,746; one-step methods are described in U.S. Pat. Nos. 3,215,707, 3,231,587; 3,912,764; 4,110,349; and 4,234,435; thermal methods for forming succinimides of tetraethylene pentamine are described in U.S. Pat. Nos. 3,361,673 and 3,401,118; methods for forming succinimides of halogenated alpha-olefin polymers are described in U.S. Pat. No. 5,266,223; free radical methods are described in U.S. Pat. Nos. 4,505,834; 4,749,505, and 4,863,623; grafting methods are described in U.S. Pat. Nos. 4,340,689; 4,670,515; 4,948,842 and 5,075,383.

The dispersants may also be post-treated by conventional methods by a reaction with any of a variety of agents. Among these are boron compounds (such as boric acid), urea, thiourea, dimercaptothiadiazoles, carbon disulfide, aldehydes, ketones, carboxylic acids such as terephthalic acid, hydrocarbon-substituted succinic anhydrides, maleic anhydride, nitriles, epoxides, and phosphorus compounds. In one embodiment, the post-treated dispersant is borated.

Dispersants are also useful in maintaining compatibility and mutual solubility among components in solution, whether in a finished lubricant or in a concentrate. To that end, the use of any of a number of dispersants as disclosed herein may be useful. Examples include succinimide dispersants (such as a condensate of PIBSA with a poly (ethyleneamine); in one embodiment the PIBSA and polyethylene(amine) may be reacted in a weight ratio of 10:1 to 15:1); post-treated succinimide dispersants (e.g., those borated or treated with dimercaptothiadiazole); ester-containing dispersants (such as a condensate of PIBSA with a polyol and optionally with a poly(ethyleneamine); in one embodiment PIBSA may be reacted with a combination of pentaerythritol and poly(ethyleneamine) having a wt. ratio of 5.5:1 to 6:1); other dispersants as described above; various polymeric species such as olefin copolymer-based dispersant-viscosity modifiers; and olefin-methacrylate copolymers. In one embodiment, a dispersant useful for maintaining compatibility among components may be an ester-containing dispersant as described above. In another embodiment, a useful dispersant may be a succinimide-containing dispersant. The amount of dispersant used in such an application will depend on its chemical nature and the concentration of the components in the formulation, as will be evident to the person skilled in the art. In one embodiment, an oil concentrate of 30 wt % of an olefin/acid copolymer (b) 7 wt % of polyisobutylene (c) may include 0.5 to 2%, e.g., 1% of a suitable dispersant; additionally, a small amount of a polyalphaolefin may be included (e.g., 0.5 to 2%, or 1%). In another embodiment, a concentrate of 39.6 wt % of an olefin/acid copolymer (b) and 4.4 wt % of polyisobutylene (c) may include a combination of a suitable ester dispersant and polyalphaolefin (e.g. 1 wt % dispersant and 1-2 wt % polyalphaolefin).

In certain embodiments the dispersant may be present in the lubricant in amounts of 0 to 5 percent by weight. In one embodiment, the lubricant is free from or substantially free from added dispersant. In certain embodiments, the amount of the dispersant may be 0.01 to 2.5 wt %, or 0.01 to 2 wt. %, or 0.01 to 1.5 wt. %, or 0.5 to 2.5 wt. %, or 0.75 to 2 wt %, or 1 to 1.5 wt. %. In other embodiments, the amount of dispersant may be greater than 2.5 percent by weight, e.g., 2.6 to 5 percent.

The lubricating composition optionally further includes known neutral or overbased detergents, i.e., ones prepared by conventional processes known in the art. Suitable detergents include phenates, sulfur containing phenates, sulfonates, salixarates, salicylates, carboxylic acid, phosphorus acids, alkyl phenols, sulfur coupled alkyl phenol compounds, and saligenins. The detergent may be present at 0 to 2.5 wt %, or 0 wt % to 1 wt. %, or 0.01 wt. % to 1 wt. %, or 0.05 wt. % to 0.75 wt. %, or 0.1 wt. % to 0.75 wt. % of the lubricating composition.

Antioxidant compounds useful herein as oxidation inhibitors include sulfurized olefins, alkylated diphenylamines, phenyl-alpha-naphthylamines ("PANA") or alkylated PANA, hindered phenols, molybdenum dithiocarbamates, and mixtures and derivatives thereof. Antioxidant compounds may be used alone or in combination.

Exemplary diphenylamines include diarylamines, such as alkylated diphenylamines.

Exemplary hindered phenol antioxidants may contain a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol, 4-dodecyl-2,6-di-tert-butylphenol, and mixtures thereof. In one embodiment, the hindered phenol antioxidant is an ester and may include, e.g., Irganox™ L-135 from Ciba. Suitable examples of molybdenum dithiocarbamates which may be used as an antioxidant include commercial materials sold under the trade names Vanlube 822™ and Molyvan™ A from R. T. Vanderbilt Co., Ltd., and Adeka Sakura-Lube™ S-100, S-165 and S-600 from Asahi Denka Kogyo K. K, and mixtures thereof.

The antioxidants may be present at up to 2 wt. %, or up to 1.5 wt. %, or up to 1.0 wt. %, or up to 0.7 wt. % of the lubricating composition, e.g., 0.01 to 2% or 0.1 to 1.5%.

Viscosity index improvers, other than the polymers disclosed elsewhere herein, may include hydrogenated styrene-butadiene rubbers, ethylene-propylene copolymers, hydrogenated styrene-isoprene polymers, hydrogenated diene polymers, polyalkyl-styrenes, polyolefins, polyalkyl(meth) acrylates, and mixtures thereof. In one embodiment, the viscosity index improver is a poly(meth)acrylate.

The lubricating composition optionally further includes at least one antiwear agent, which are described in some detail below.

Examples of suitable antiwear agents include oil soluble amine salts of phosphorus compounds, sulfurized olefins, metal dihydrocarbyldithiophosphates (such as zinc dialkyldithiophosphates), thiocarbamate-containing compounds, such as thiocarbamate esters, thiocarbamate amides, thiocarbamic ethers, alkylene-coupled thiocarbamates, and bis (S-alkyldithiocarbamyl) disulfides.

In one embodiment, the oil soluble phosphorus amine salt antiwear agent includes an amine salt of a phosphorus acid ester or mixtures thereof. The amine salt of a phosphorus acid ester includes phosphoric acid esters and amine salts thereof; dialkyldithiophosphoric acid esters and amine salts thereof; amine salts of phosphorus compounds; and amine salts of phosphorus-containing carboxylic esters, ethers, and amides; and mixtures thereof. The amine salt of a phosphorus acid ester may be used alone or in combination.

In one embodiment, the oil soluble phosphorus amine salt includes partial amine salt-partial metal salt compounds or mixtures thereof. In one embodiment, the phosphorus compound further includes a sulfur atom in the molecule. In one embodiment, the amine salt of the phosphorus compound is ashless, i.e., metal-free (prior to being mixed with other components).

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleylamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine, and morpholine.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine.

In one embodiment, the phosphorus acid amine salt includes an amine with $C_{11}$ to $C_{14}$ tertiary alkyl primary groups or mixtures thereof. In one embodiment, the phosphorus acid amine salt includes an amine with $C_{14}$ to $C_{18}$ tertiary alkyl primary amines or mixtures thereof. In one embodiment, the phosphorus acid amine salt includes an amine with $C_{18}$ to $C_{22}$ tertiary alkyl primary amines or mixtures thereof.

Mixtures of amines may also be used herein. In one embodiment a useful mixture of amines is "Primene® 81R" and "Primene® JMT." Primene® 81R and Primene® JMT (both produced and sold by Rohm & Haas) are mixtures of $C_{11}$ to $C_{14}$ tertiary alkyl primary amines and $C_{18}$ to $C_{22}$ tertiary alkyl primary amines respectively.

In one embodiment, oil soluble amine salts of phosphorus compounds include a sulfur-free amine salt of a phosphorus-containing compound which is obtained/obtainable by a process comprising: reacting an amine with either (i) a hydroxy-substituted di-ester of phosphoric acid, or (ii) a phosphorylated hydroxy-substituted di- or tri-ester of phosphoric acid. A more detailed description of compounds of this type is disclosed in US Pub. No. 20080182770.

In one embodiment, the hydrocarbyl amine salt of an alkylphosphoric acid ester is the reaction product of a $C_{14}$ to $C_{18}$ alkylated phosphoric acid with the Primene 81R™ product (produced and sold by Rohm & Haas) which is a mixture of $C_{11}$ to $C_{14}$ tertiary alkyl primary amines.

Examples of hydrocarbyl amine salts of dialkyldithiophosphoric acid esters include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81R™, and mixtures thereof.

In one embodiment, the dithiophosphoric acid may be reacted with an epoxide or a glycol. This reaction product is further reacted with a phosphorus acid, anhydride, or lower ester. The epoxide includes an aliphatic epoxide or a styrene oxide. Examples of useful epoxides include ethylene oxide, propylene oxide, butene oxide, octene oxide, dodecene oxide, and styrene oxide. In one embodiment, the epoxide is propylene oxide. The glycols may be aliphatic glycols having from 1 to 12, or from 2 to 6, or 2 to 3 carbon atoms. The dithiophosphoric acids, glycols, epoxides, inorganic phosphorus reagents, and methods of forming the same are described in U.S. Pat. Nos. 3,197,405 and 3,544,465. The resulting acids may then be salted with amines. An example of suitable dithiophosphoric acid is prepared by adding phosphorus pentoxide (about 64 grams) at 58° C. over a period of 45 minutes to 514 grams of hydroxypropyl O,O-di(4-methyl-2-pentyl)phosphorodithioate (prepared by reacting di(4-methyl-2-pentyl)phosphorodithioic acid with 1.3 moles of propylene oxide at 25° C.). The mixture is heated at 75° C. for 2.5 hours, mixed with a diatomaceous earth, and filtered at 70° C. The filtrate contains 11.8% by weight phosphorus, 15.2% by weight sulfur, and an acid number of 87 (bromophenol blue).

The dithiocarbamate-containing compounds may be prepared by reacting a dithiocarbamate acid or salt with an unsaturated compound. The dithiocarbamate containing compounds may also be prepared by simultaneously reacting an amine, carbon disulfide and an unsaturated compound. Generally, the reaction occurs at a temperature from 25° C. to 125° C.

Another type of antiwear agent is a sulfurized olefin. Examples of suitable olefins that may be sulfurized to form the sulfurized olefin include propylene, butylene, isobutylene, pentene, hexane, heptene, octane, nonene, decene, undecene, dodecene, undecyl, tridecene, tetradecene, pentadecene, hexadecene, heptadecene, octadecene, nonodecene, eicosene, and mixtures thereof. Hexadecene, heptadecene, octadecene, nonodecene, eicosene, and mixtures thereof, and their dimers, trimers and tetramers are especially useful olefins. Alternatively, the olefin may be a Diels-Alder adduct of a diene such as 1,3-butadiene and an unsaturated ester, such as butyl acrylate.

Another class of sulfurized olefin includes fatty acids and their esters. The fatty acids are often obtained from vegetable oil or animal oil; and typically contain 4 to 22 carbon atoms. Examples of suitable fatty acids and their esters include triglycerides, oleic acid, linoleic acid, palmitoleic acid, and mixtures thereof. The fatty acids may be obtained from lard oil, tall oil, peanut oil, soybean oil, cottonseed oil, sunflower seed oil, and mixtures thereof. In one embodiment fatty acids and/or ester are mixed with olefins.

In an alternative embodiment, the ashless antiwear agent may be a monoester of a polyol and an aliphatic carboxylic acid, often an acid containing 12 to 24 carbon atoms. Often the monoester of a polyol and an aliphatic carboxylic acid is in the form of a mixture with a sunflower oil or the like, which may be present in the friction modifier mixture from 5 to 95, in several embodiments from 10 to 90, or from 20 to 85, or 20 to 80 weight percent of the mixture. The aliphatic carboxylic acids (especially a monocarboxylic acid) which form the esters are those acids typically containing 12 to 24, or from 14 to 20 carbon atoms. Examples of carboxylic acids include dodecanoic acid, stearic acid, lauric acid, behenic acid, and oleic acid.

Polyols include diols, triols, and alcohols with higher numbers of alcoholic OH groups. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol. The polyol can be diethylene glycol, triethylene glycol, glycerol, sorbitol, pentaerythritol, dipentaerythritol, or mixture thereof.

The commercially available monoester known as "glycerol monooleate" is believed to include 60±5 percent by weight of glycerol monooleate, 35±5 percent glycerol dioleate, and less than 5 percent trioleate and oleic acid. The amounts of the monoesters, described above, are calculated based on the actual, corrected, amount of polyol monoester present in any such mixture.

The antiwear agents may be present at 0 to 5 wt. % or 0.2 wt % to 5 wt. % or 0.5% wt. to 5 wt. % or 0.5 wt. % to 3 wt. % or 0.3 wt % to 3 wt. % or 0.2 wt % to 0.5 wt % or 1 wt. % to 2 wt. % of the lubricating composition The lubricating composition may also contain an antiscuffing agent. Anti-scuffing agent compounds are believed to decrease adhesive wear and are often sulfur containing compounds. Typically, the sulfur containing compounds include sulfurized olefins, organic sulfides and polysulfides, such as dibenzyldisulfide, bis-(chlorobenzyl) disulfide, dibutyl tetrasulfide, di-tertiary butyl polysulfide, sulfurized methyl ester of oleic acid, sulfurized alkylphenol, sulfurized dipentene, sulfurized terpene, sulfurized Diels-Alder adducts, alkyl sulphenyl N,N-dialkyl dithiocarbamates, the reaction product of polyamines with polybasic acid esters, chlorobutyl esters of 2,3-dibromopropoxy-isobutyric acid, acetoxymethyl esters of dialkyl dithiocarbamic acid and acyloxyalkyl ethers of xanthogenic acids, and mixtures thereof. The antiscuffing agents may be present at 0% wt. to 6 wt. % or 1 wt. % to 6 wt. % or 3 wt. % to 6 wt. % of the lubricating composition.

The lubricant composition may also contain an extreme pressure agent. Extreme pressure (EP) agents that are soluble in the oil include sulfur- and chlorosulfur-containing EP agents, chlorinated hydrocarbon EP agents and phosphorus EP agents. Examples of such EP agents include chlorinated wax; sulfurized olefins (such as sulfurized isobutylene), organic sulfides and polysulfides such as dibenzyldisulfide, bis(chlorobenzyl) disulfide, dibutyl tetrasulfide, sulfurized methyl ester of oleic acid, sulfurized alkylphenol, thiadiazoles such as dimercaptothiadiazole derivatives, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described, for example, in U.S. Pat. No. 3,197,405).

Suitable thiadiazoles include hydrocarbyl-substituted 2,5-dimercapto-1,3,4-thiadiazole and unsubstituted equivalents thereof that are substantially soluble at 25° C. in non-polar media such as an oil of lubricating viscosity. The total number of carbon atoms in the hydrocarbyl-substituents, which tend to promote solubility, will generally be 8 or more, or 10 or more, or at least 12. If the thiadiazole has two or more hydrocarbyl groups, the number of carbon atoms per group may be below 8 provided the total number of carbons is 8 or more.

Examples of thiadiazoles include 2,5-(tert-octyldithio)-1,3,4-thiadiazole 2,5-(tert-nonyldithio)-1,3,4-thiadiazole, 2,5-(tert-decyldithio)-1,3,4-thiadiazole, 2,5-(tert-undecyldithio)-1,3,4-thiadiazole, 2,5-(tert-dodecyldithio)-1,3,4-thiadiazole, 2,5-(tert-tridecyldithio)-1,3,4-thiadiazole, 2,5-(tert-tetradecyldithio)-1,3,4-thiadiazole, 2,5-(tert-pentadecyldithio)-1,3,4-thiadiazole, 2,5-(tert-hexadecyldithio)-1,3,4-thiadiazole, 2,5-(tert-heptadecyldithio)-1,3,4-thiadiazole, 2,5-(tert-octadecyldithio)-1,3,4-thiadiazole, 2,5-(tert-nonadecyldithio)-1,3,4-thiadiazole or 2,5-(tert-eicosyldithio)-1,3,4-thiadiazole, and oligomers and mixtures thereof. In one embodiment, the dimercaptothiadiazole includes 2,5-dimercapto-1,3,4-thiadiazole.

Thiadiazoles may be derived from 2,5-dimercapto-1,3,4-thiadiazole, or a hydrocarbyl-substituted 2,5-dimercapto-1,3,4-thiadiazole, or an oligomer thereof. The oligomers of hydrocarbyl-substituted 2,5-dimercapto-1,3,4-thiadiazole typically form by forming a sulfur-sulfur bond between 2,5-dimercapto-1,3,4-thiadiazole units to form oligomers of two or more of the thiadiazole units. In one embodiment the dimercaptothiadiazole (typically a 2,5-dimercapto-1,3,4-thiadiazole) may be formed by reacting a dimercaptothiadiazole with an ethylenically unsaturated amide or ester. The amide or ester may include hydrocarbyl-(meth)acrylate or hydrocarbyl-(meth)acrylamide, a hydrocarbyl-substituted maleate, a hydrocarbyl-substituted crotonate, a hydrocarbyl-substituted cinnamate, or mixtures thereof.

In one embodiment, the dimercaptothiadiazole (typically a 2,5-dimercapto-1,3,4-thiadiazole) may be a compound represented by the formula:

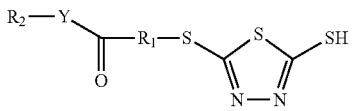

where:

$R_1$ may be an alkylene group containing 1 to 5, or 1 to 3, or 2 carbon atoms;

$R_2$ may be a hydrocarbyl group containing 1 to 16, or 2 to 8, or 4 carbon atoms;

Y may be —O— or >$NR_3$ (typically Y may be —O—); and $R_3$ may be hydrogen or $R_2$.

The thiadiazole of the formula above may be prepared by reacting the appropriate hydrocarbyl-(meth)acrylate or hydrocarbyl-(meth)acrylamide with 2,5-dimercapto-1,3,4-thiadiazole. The reaction of hydrocarbyl-(meth)acrylate or hydrocarbyl-(meth)acrylamide with 2,5-dimercapto-1,3,4-thiadiazole may be carried out at a temperature in the range of 50° C. to 150° C., or 70° C. to 120° C., or 80° C. to 100° C. In one embodiment the dimercaptothiadiazole salt (typically a 2,5-dimercapto-1,3,4-thiadiazole salt) may be prepared by reacting a dimercaptothiadiazole with an epoxide.

The extreme pressure agents may be present at 0 to 6 wt. % or 0.2 wt. % to 6 wt. % or 1% wt. to 6 wt. % or 2 wt. % to 6 wt. % or 3 wt. % to 6 wt. % or 0.1 wt % to 1.5 wt. % of the lubricating composition.

Corrosion inhibitors that may be useful in the exemplary include fatty amines, octylamine octanoate, and condensation products of dodecenyl succinic acid or anhydride and a fatty acid such as oleic acid with a polyamine. The corrosion inhibitors may be present at 0 to 3 wt. % or 0.01% wt. to 3 wt. %, or 0.01 to 1 wt. %, or 0.05 to 0.5 wt. % of the lubricating composition.

Foam inhibitors that may be useful in the exemplary compositions include silicones; copolymers of ethyl acrylate and 2-ethylhexylacrylate, which can optionally further include vinyl acetate; and demulsifiers including trialkyl phosphates, polyethylene glycols, polyethylene oxides, polypropylene oxides and (ethylene oxide-propylene oxide) polymers.

Pour point depressants that may be useful in the exemplary compositions include polyalphaolefins, esters of maleic anhydride-styrene copolymers, alkyl fumarate-vinyl acetate copolymers, poly(meth)acrylates, polyacrylates, and polyacrylamides such as polyalkylmethacrylates.

Friction modifiers that may be useful in the exemplary compositions include fatty acid derivatives such as amines, esters, epoxides, fatty imidazolines, condensation products of carboxylic acids and polyalkylene-polyamines and amine salts of alkylphosphoric acids.

In one embodiment the friction modifier may be selected from the group consisting of long chain fatty acid derivatives of amines, long chain fatty esters, or derivatives of a long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. As used herein the term "fatty alkyl or fatty" in relation to friction modifiers means a carbon chain having 10 to 22 carbon atoms, typically a straight carbon chain. The friction modifier may be present at 0 wt. % to 7 wt. %, 0.1 wt. % to 6 wt. %, 0.25 wt. % to 3.5 wt. %, 0.5 wt. % to 2.5 wt. %, and 1 wt. % to 2.5 wt. %, or 0.05 wt. % to 0.5 wt. % or 5 to 7 wt. % of the lubricating composition.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurized fatty compounds and olefins, molybdenum dialkyldithiophosphates, molybdenum dithiocarbamates, and monoesters of a polyol and an aliphatic carboxylic acid derived or derivable from sunflower oil or soybean oil.

In one embodiment the friction modifier may be a long chain fatty acid ester. In another embodiment the long chain fatty acid ester may be a mono-ester and in another embodiment the long chain fatty acid ester may be a (tri)glyceride.

INDUSTRIAL APPLICATION

The method and lubricating composition of the invention may be suitable for refrigeration lubricants, greases, gear oils, axle oils, drive shaft oils, traction oils, manual transmission oils, automatic transmission oils, metal working fluids, hydraulic oils, or internal combustion engine oils. The foregoing includes driveline lubricants. In order for a lubricant to be suitable for use as a driveline lubricant, it will typically have viscosity properties as defined by SAE J306 specification and viscosity modifier selection typically determined by the fluid remaining in-grade following evaluation by CEC L-45-A-99.

In one embodiment the method and lubricating composition of the invention may be suitable for at least one of gear oils, axle oils, drive shaft oils, traction oils, manual transmission oils, automatic transmission oils.

An automatic transmission includes continuously variable transmissions (CVT), infinitely variable transmissions (IVT), toroidal transmissions, continuously slipping torque converter clutches (CSTCC), stepped automatic transmissions or dual clutch transmissions (DCT).

The use (may also be referred to as a method) and copolymer described herein is capable of providing a lubricant with at least one (or at least two, or all) of acceptable or improved shear stability, acceptable or improved viscosity index control, acceptable or improved oxidation control, acceptable or improved low temperature viscosity, and acceptable or improved efficiency in terms of power transfer. The copolymer may be employed as an oil of lubricating viscosity in the presence or absence of other base oil.

When the copolymer with pendant groups further includes a nitrogen containing compound, the copolymer may further have acceptable/improved dispersancy properties (cleanliness) and oxidation control.

If used as an engine lubricant, the internal combustion engine may be a 2-stroke or 4-stroke engine. Suitable internal combustion engines include marine diesel engines, aviation piston engines, low-load diesel engines, and automobile and truck engines.

In several embodiments a suitable lubricating composition includes the copolymer present (on an actives basis) in ranges as shown in the following table.

TABLE

| Embodiments | wt % of olefin-carboxy copolymer (b) | wt % of lower olefin polymer (c) | wt % of Other Performance Additives[a] | wt % of Oil of Lubricating Viscosity |
|---|---|---|---|---|
| A | 1.5-54 | 0.3-30 | 0-20 | 5-98.2 |
| B | 2-50 | 0.5-20 | 0.01-15 | 15-97.4 |
| C | 3-48 | 0.8-22 | 0.5-20 | 10-95.7 |
| D | 5-44 | 1-25 | 0.5-15 | 16-93.5 |
| E | 12-44 | 3-25 | 0.5-15 | 16-84.5 |
| F | 5-22 | 1-12 | 0.5-15 | 51-93.5 |

[a]containing conventional amounts of diluent oil

As used herein, the term "condensation product" is intended to encompass esters, amides, imides and other such materials that may be prepared by a condensation reaction of an acid or a reactive equivalent of an acid (e.g., an acid halide, anhydride, or ester) with an alcohol or amine, irrespective of whether a condensation reaction is actually performed to lead directly to the product. Thus, for example, a particular ester may be prepared by a transesterification reaction rather than directly by a condensation reaction. The resulting product is still considered a condensation product, as is understood by those skilled in the art and as the term is commonly used.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

Preparation of the Copolymer

Preparative Example 1

1-Dodecene and Maleic Anhydride Copolymer

Copolymer Backbone Preparation (Cpp): a copolymer is prepared by reacting in a 3 liter flask 1 mole of maleic anhydride, and Y moles (defined below) of 1-dodecene in the presence of 60 wt % of toluene solvent. The flask is fitted with a flange lid and clip, PTFE stirrer gland, rod and overhead stirrer, thermocouple, nitrogen inlet port and water-cooled condenser. Nitrogen is blown through the flask at 0.028 $m^3$/hr (or 1 SCFH). A separate 500 mL flask with a side arm is charged with 0.05 moles of tert-butyl peroxy-2-ethylhexanoate initiator (a commercially available initiator from Akzo Nobel, known as Trigonox® 21S), optionally n-dodecyl mercaptan (chain transfer agent, CTA) and additional toluene. A nitrogen line is fitted to the arm and nitrogen is applied at 0.085 $m^3$/hr (or 0.3 SCFH) for 30 minutes. The 3 L flask is heated to 105° C. The Trigonox 21S initiator/toluene mixture is pumped from the 500 mL flask into the 3 L flask via a Masterflex™ pump (flow rate set at 0.8 mL/min) over a period of 5 hours. The contents of the 3 L flask are stirred for 1 hour before cooling to 95° C. The contents of the 3 L flask are stirred overnight. Typically a clear colorless gel is obtained. The amount of each reagent is shown in the table below.

The copolymers prepared are as reported in the following table:

| Copolymer Prep Example | γ moles of 1-Dodecene | Mole Ratio of CTA to Initiator |
|---|---|---|
| Cpp1 | 1 | 0:1 |
| Cpp2 | 0.95 | 0:1 |
| Cpp3 | 0.93 | 0:1 |
| Cpp4 | 0.91 | 0:1 |
| Cpp5 | 0.90 | 0:1 |
| Cpp6 | 0.85 | 0:1 |
| Cpp7 | 0.80 | 0:1 |
| Cpp8* | 1 | 0.6:1 |

*For Cpp8 the amount of toluene solvent added is 55 wt % rather than 60 wt %.

Preparative Example of an esterified copolymer of dodecene-maleic anhydride polymer (Esc): the copolymer from above is esterified in the presence of a linear alcohol and a primary alcohol branched at the β- or higher position. The esterified copolymer is prepared in a flask fitted with a Dean-Stark trap capped with a condenser. An amount of copolymer containing 1 mole (relative amount) of carboxy groups is heated in the flask to 110° C. and stirred for 30 minutes. One mole of alcohol (relative to the amount of carboxy groups) is added. If the amount of the primary alcohol branched at the β- or higher position is greater than one mole, only one mole is added at this point. Conversely if less than one mole of the primary alcohol branched at the β- or higher position is present, sufficient linear alcohol is used to provide a total of one mole equivalent of alcohol. The alcohol is pumped into the flask via a peristaltic pump over a period of 35 minutes. Catalytic amounts of methane sulfonic acid along with the remaining moles of alcohol are then pumped into the flask over a period of 5 hours while heating to and holding at 145° C. and removing water in the Dean-Stark trap.

The reaction temperature is reduced to 135° C., and sufficient butanol is added sequentially to the flask until the total acid number (TAN) is not higher than 4 mg KOH/g. The flask is heated to 150° C. and sufficient sodium hydroxide is added to quench the methanesulfonic acid. The flask is cooled to ambient temperature resulting in an esterified copolymer. The procedure employs the materials listed in the table below.

| Ester Copolymer | Copolymer Prep | Moles of Linear Alcohol | Moles of Branched Alcohol B1 | B2 | B3 |
|---|---|---|---|---|---|
| Esc1 | Cpp1 | 1.8 | 0.2 | | |
| Esc2 | Cpp2 | 1.8 | 0.2 | | |
| Esc3 | Cpp3 | 1.8 | 0.2 | | |
| Esc4 | Cpp4 | 1.8 | 0.2 | | |
| Esc5 | Cpp5 | 1.8 | 0.2 | | |
| Esc6 | Cpp6 | 1.8 | 0.2 | | |
| Esc7 | Cpp7 | 1.8 | 0.2 | | |
| Esc8 | Cpp8 | 1.8 | 0.2 | | |
| Esc9 | Cpp8 | 1.6 | | 0.4 | |
| Esc10 | Cpp8 | 1.4 | | | 0.6 |
| Esc11 | Cpp8 | 1.6 | 0.4 | | |
| Esc12 | Cpp8 | 1.4 | | 0.6 | |
| Esc13 | Cpp8 | 1 | | 1 | |
| Esc14 | Cpp1 | 1 | | | 1 |
| Esc15 | Cpp1 | 1 | 1 | | |
| Esc16 | Cpp2 | 0.5 | | | 1.5 |
| Esc17 | Cpp5 | 0 | 2 | | |
| Esc18 | Cpp5 | 0 | | 2 | |
| Esc19 | Cpp5 | 0 | | | 2 |
| Esc20 | Cpp3 | 0 | 2 | | |
| Esc21* | Cpp8 | 2 | 0 | | |
| Esc22 | Cpp1 | 0 | 2 | | |
| Esc23 | Cpp8 | 1.4 | 0.6 | | |

Footnotes:
The number of moles of alcohols are per mole of incorporated maleic anhydride
The linear alcohol is a $C_{8-10}$ mixture commercially available as Alfol ®810
B1 is 2-hexyldecanol
B2 is 2-ethylhexanol
B3 is a 2-octyldodecanol
Esc21* is a comparative esterified copolymer having the same polymer backbone as the invention, but only having linear ester groups Preparative Example of an esterified copolymer capped with an amine (Ecca): each esterified copolymer from above is reacted with an amine in a flask fitted with a Dean-Stark trap capped with a condenser. Sufficient amine is added to provide the esterified copolymer with a weight percent nitrogen content as shown in the table below. The amine is charged into the flask over a period of 30 minutes and stirred for 16 hours at 150° C. The flask is cooled to 115° C. and drained. The resultant product is vacuum stripped at 150° C. and held for 2.5 hours. The procedure employs the materials listed in the table below. The table below presents the information for a representative number of esterified copolymers capped with an amine.

| Esterified copolymer capped with amine | Esterified Copolymer | Amine | Nitrogen Content (wt %) |
|---|---|---|---|
| Ecca1 | Esc1 | 1 | 0.10 |
| Ecca2 | Esc1 | 1 | 0.15 |
| Ecca3 | Esc1 | 2 | 0.10 |
| Ecca4 | Esc1 | 3 | 0.10 |
| Ecca5 | Esc1 | 4 | 0.10 |
| Ecca6 | Esc2 | 5 | 0.10 |
| Ecca7 | Esc3 | 6 | 0.10 |
| Ecca8 | Esc4 | 7 | 0.10 |
| Ecca9 | Esc5 | 8 | 0.10 |
| Ecca10 | Esc8 | 1 | 0.40 |
| Ecca11 | Esc9 | 2 | 0.40 |
| Ecca12 | Esc10 | 3 | 0.40 |
| Ecca13 | Esc11 | 1 | 0.40 |
| Ecca14 | Esc12 | 5 | 0.40 |
| Ecca15 | Esc13 | 5 | 0.40 |
| Ecca16 | Esc14 | 2 | 0.10 |
| Ecca17 | Esc15 | 1 | 0.10 |
| Ecca18 | Esc1 | 1 | 0.20 |
| Ecca19 | Esc7 | 2 | 0.10 |
| Ecca20 | Esc10 | 3 | 0.10 |
| Ecca21 | Esc11 | 4 | 0.10 |

-continued

| Esterified copolymer capped with amine | Esterified Copolymer | Amine | Nitrogen Content (wt %) |
|---|---|---|---|
| Ecca22 | Esc13 | 5 | 0.10 |
| Ecca23 | Esc14 | 6 | 0.10 |
| Ecca24 | Esc15 | 7 | 0.10 |
| Ecca25 | Esc16 | 8 | 0.10 |
| Ecca26 | Esc19 | 1 | 0.10 |
| Ecca27 | Esc20 | 3 | 0.10 |
| Ecca28 | Esc21 | 2 | 0.10 |
| Ecca29 | Esc14 | 1 | 0.10 |
| Ecca30 | Esc22 | 1 | 0.10 |
| Ecca31 | Esc23 | 2 | 0.10 |
| Ecca32 | Esc8 | 2 | 0.10 |

Footnote:
Amine 1 is 1-(2-amino-ethyl)-imidazolidin-2-one
Amine 2 is 4-(3-aminopropyl)morpholine
Amine 3 is 3-(dimethylamino)-1-propylamine
Amine 4 is N-phenyl-p-phenylenediamine
Amine 5 is N-(3-Aminopropyl)-2-pyrrolidinone
Amine 6 is Aminoethyl acetamide
Amine 7 is β-alanine methyl ester
Amine 8 is 1-(3-aminopropyl) imidazole

Preparative Example 2

1-octene-maleic anhydride copolymers are prepared in the same way as Preparative Example 1, except the 1-dodecene is replaced with 1-octene. All other reagents (initiators, alcohols, and amines), concentrations, and reaction conditions are the same.

Preparative Example 3

1-decene-maleic anhydride copolymers are prepared in the same way as Preparative Example 1, except the 1-dodecene is replaced with 1-decene. All other reagents (initiators, alcohols, and amines), concentrations, and reaction conditions are the same.

Preparative Example 4

1-tetradecene-maleic anhydride copolymers are prepared in the same way as Preparative Example 1, except the 1-dodecene is replaced with 1-tetraadecene. All other reagents (initiators, alcohols, and amines), concentrations, and reaction conditions are the same.

Preparative Example 5

1-hexadecene-maleic anhydride copolymers are prepared in the same way as Preparative Example 1, except the 1-dodecene is replaced with 1-hexadecene. All other reagents (initiators, alcohols, and amines), concentrations, and reaction conditions are the same.

Lubricant Formulations (LF)

Lubricants are formulated containing, in addition to oil of lubricating viscosity and other conventional additives, mixtures of polymers as identified in the table below:

| Lubricant | Esterified, amine-capped polymer | | Olefin polymer | |
|---|---|---|---|---|
| Formulation | Identity | Amount, % | Identity* | Amount, % |
| LF1 | Ecca1 | 30 | A | 7 |
| LF2 | Ecca1 | 15 | B | 2 |
| LF3 | Ecca1 | 25 | A | 12 |
| LF4 | Ecca2 | 35 | A | 20 |
| LF5 | Ecca2 | 30 | A | 7 |
| LF6 | Ecca3 | 30 | A | 10 |
| LF7 | Ecca10 | 30 | A | 7 |
| LF8 | Ecca10 | 21 | B | 7 |
| LF9 | Ecca10 | 40 | C | 20 |
| LF10 | Ecca18 | 28 | A | 9 |
| LF11 | Ecca21 | 2 | B | 1 |

-continued

| Lubricant | Esterified, amine-capped polymer | | Olefin polymer | |
|---|---|---|---|---|
| Formulation | Identity | Amount, % | Identity* | Amount, % |
| LF12 | Ecca22 | 10 | B | 10 |
| LF13 | Ecca 25 | 40 | B | 4 |

A = Polyisobutylene, number average molecular weight about 2000

B = Propylene/isobutylene copolymer, number average molecular weight about 1800

C = Butylene polymer, number average molecular weight about 1500

The lubricants of the present invention, comprising the esterified, optionally amine-condensed, polymer and the lower olefin polymer exhibit improved film thickness in high pressure lubricant applications, relative to other viscosity modified formulation such as those containing the esterified polymer alone.

Elastohydrodynamic (EHD) film thickness refers to the thickness of lubricant film between machine elements that are in contact at high pressure, typically 0.3 to 3 GPa. Liquid films are employed to prevent direct metallic contact which would result in high friction and rapid wear. Under moderate to high load, the mechanism of film protection is referred to as elastohydrodynamic (EHD) lubrication. EHD film thickness measurement is carried out using a commercially available ultra-thin EHD film thickness tester. Optical interferometry techniques are used to measure fluid film thickness under rolling conditions in a highly concentrated contact formed between a steel ball and glass disc. EHD films are measured from 40 to 120° C. at a Hertz pressure of 0.5 GPa.

Examples 1-6

A series of lubricant formulation is prepared for testing. The base oil is a commercial polyalphaolefin of viscosity about 4 $mm^2/s$ at 100° C. The formulations also contain 10% of a commercial additive package comprising a sulfurized olefin, a mixed amine salt of phosphorus acids, other phosphorus compound(s), an overbased sulfonate detergent, an organic ester friction modifier, dispersants (ester based and amine based), an alkyl thiadiazole, an acrylate polymer, and diluent oil. In this base formulation are included various amounts of an α-olefin ester polymer and/or a polyisobutylene, in the amounts shown in the table below. The total amounts of the two polymers is adjusted to obtain lubricants of the same viscosity at 100° C.

| | Example: | | | | | |
|---|---|---|---|---|---|---|
| | 1* | 2 | 3 | 4 | 5 | 6* |
| α-olefin/ester copolymer[a] (b) wt % | 0 | 22.8 | 27.9 | 33.5 | 39.6 | 46.65 |
| Polyisobutene (c) wt % | 27.9 | 15.2 | 11.9 | 8.3 | 4.4 | 0 |
| Wt. ratio b:c | 0:100 | 60:40 | 70:30 | 80:20 | 90:10 | 100:0 |
| Kinematic viscosity, 40° C., $mm^2/s$ | 127.2 | 115.8 | 111.7 | 108.2 | 105.1 | 102.5 |
| 100° C., $mm^2/s$ | 17.6 | 17.6 | 17.5 | 17.4 | 17.5 | 17.6 |
| Viscosity index | 153 | 168 | 172 | 178 | 183 | 189 |
| Brookfield viscosity, −40° C. (cP) | 88000 | 69000 | 62000 | 54000 | 47500 | 41500 |
| | EHD film thickness at 0.2 m/sec, 0.5 GPa (nm) | | | | | |
| 40° C. | 172 | 145 | 141 | 140.5 | 136 | 123 |
| 60° C. | 86.9 | 89.2 | 86.1 | 83.5 | 82.4 | 72.9 |
| 80° C. | 48.9 | 60.2 | 57.4 | 55.7 | 55.7 | 42.0 |
| 100° C. | 28.7 | 40.9 | 41.7 | 40.8 | 42.0 | 26.8 |
| 120° C. | 20.0 | 34.0 | 33.4 | 29.8 | 33.4 | 18.1 |

*A comparative or reference example

[a]Copolymer of maleic anhydride and 1-dodecene esterified with 90 mol. % linear alcohols and 10 mol. % longer chain branched alcohols, further reacted with imidazol-idinone derived from diethyltriamine to a nitrogen level of 0.15%. This copolymer contains less than 5% oil, typically about 1% oil, which is not separately accounted for in the above amounts. Kinematic viscosity is by ASTM D445.

Viscosity index is by ASTM D2270.

Brookfield viscosity is by ASTM D2983

The results show that the presence of a relatively minor proportion of polyisobutylene (c) in the presence of the α-olefin/ester polymer (b) leads to an increase in film thickness over that provided by (b) alone and will lead to a corresponding improvement in wear protection and fatigue life improvement. At higher temperatures, as the viscosity reduced, the EHD film thickness is reduced, and it is under these conditions that wear protection and fatigue life are particularly impacted by EHD film thickness. That is, thicker EHD films are capable of separating moving parts more effectively, improving wear protection and fatigue life. Film thickness is seen to be greater than that from either of the formulations with the α-olefin/ester polymer alone or the polyisobutylene alone (particularly at high temperature). In certain applications, the film thickness provided by polyisobutylene alone is greater than what is needed for operational efficiency. In such cases another polymer can impart improved fluid performance to a fluid without providing an overly thick film. The improved fluid performance can include higher VI, improved efficiency, lower operating temperature, and improved EHD film protection. The use of a mixture of polymer (c) with esterified copolymer (b) can thus be used to optimize the combination of film thickness and operational efficiency.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

The present technology thus includes the following embodiments:

1. A lubricant composition comprising (a) an oil of lubricating viscosity having a kinematic viscosity at 100° C. of less than 15 $mm^2/s$ and (b) an esterified copolymer with a backbone comprising units derived from (i) an α-olefin monomer of at least 6 carbon atoms and (ii) an ethylenically unsaturated carboxylic acid or derivative thereof, wherein the mole ratio of (i) α-olefin monomer to (ii) carboxylic acid or derivative monomer is 1:3 to 3:1, said copolymer optionally containing nitrogen functionality; and (c) a polymer comprising olefin monomer units of at least 3 carbon atoms, wherein at least 50 percent by weight of such units contain fewer than 6 carbon atoms and wherein less than 5 percent by weight of the monomer units are ethylene monomer units; said polymer having a kinematic viscosity at 100° C. of at least 1000 $mm^2/s$;

wherein the polymers (b) and (c) are present in a weight ratio (b):(c) of 1:10 to 10:1 or 1:1 to 10:1 or 6:4 to 9:1 and wherein the total amount of polymer (b) plus (c) is 3 to 60 percent by weight of the lubricant composition.

2. The lubricant composition of embodiment 1 wherein the oil of lubricating viscosity comprises a synthetic polyolefin hydrocarbon oil.

3. The lubricant composition of embodiment 1 or embodiment 2 wherein the backbone of copolymer (b) further comprises units of a vinyl aromatic monomer.

4. The lubricant composition of any of embodiments 1 to 3 wherein the copolymer (b) comprises an esterified copolymer of an α-olefin of 8 to 16 carbon atoms and maleic anhydride, in a mole ratio of 1:2 to 1.5:1.

5. The lubricant composition of any of embodiments 1 to 4 wherein the ester functionality of copolymer (b) is derived from a mixture of alcohols.

6. The lubricant composition of embodiment 5 wherein the mixture of alcohols comprises a primary alcohol that is branched at the β- or higher position and a linear primary alcohol.

7. The lubricant composition of embodiment 5 or embodiment 6 wherein the mixture of alcohols comprises (i) a mixture of 50 to 95 mole percent of one or more alcohols having 8 to 10 carbon atoms and 5 to 50 mole percent of one or more alcohols having 12 to 18 carbon atoms and additionally (ii) 0.01 to 5 mole percent of an alcohol having 5 or fewer carbon atoms.

8. The lubricant composition of embodiment 5 or embodiment 6 wherein the mixture of alcohols comprises (i) a mixture of 70 or 80 to 95 mole percent of one or more alcohols having 8 to 10 carbon atoms and 5 to 20 or 30 mole percent of one or more alcohols having 12 to 18 or 16 to 18 carbon atoms and additionally (ii) 0.01 to 5 mole percent of an alcohol having 5 or fewer carbon atoms.

9. The lubricant composition of any of embodiments 1 to 7 wherein the copolymer (b) contains nitrogen functionality derived from reaction of said copolymer with an amine.

10. The lubricant composition of embodiment 9 wherein the amine is selected from the group consisting of morpholines, imidazolinones, aminoamides, β-alanine alkyl esters, aliphatic amines, aromatic amines, aliphatic polyamines, aromatic polyamines, and mixtures thereof.

11. The lubricant of embodiment 9 wherein the amine comprises an aliphatic monoamine or an aliphatic polyamine.

12. The lubricant of embodiment 9 wherein the amine comprises N,N-dimethylaminopropylamine, 1-(2-aminoethyl)imidazolin-2-one, or 4-(3-aminopropyl)morpholine, or 1-(3-aminopropyl) imidazole.

13. The lubricant composition of embodiment 9 wherein the amine comprises a coupled product of 4-aminodiphenylamine.

14. The lubricant of any of embodiments 1 through 13 wherein the polymer of (b) contains 0.01 to 1.5 weight percent nitrogen (or 0.05 to 0.75, or 0.05 to 0.5, or 0.075 to 0.25 weight percent nitrogen).

15. The lubricant of any of embodiments 1 through 14 wherein 0.1 to 25% of the carboxylic acid functionalities of the units derived from the ethylenically unsaturated carboxylic acid monomer are at least one of aminated, amidated, and imidated with a nitrogen-containing compound.

16. The lubricant of any of embodiments 1 through 15 wherein the polymer of (b) has a weight average molecular weight of 5,000 to 30,000 or to 25,000.

17. The lubricant of any of embodiments 1 through 16 wherein the amount of the polymer of (b) is 2 to 40 or to 50 weight percent.

18. The lubricant of any of embodiments 1 through 17 wherein the polymer of (c) comprises polyisobutylene.

19. The lubricant of any of embodiments 1 through 18 wherein the polymer of (c) has a number average molecular weight of 1000 or 1500 to 3000.

20. The lubricant of any of embodiments 1 through 19 wherein the amount of the polymer of (c) is 1 to 20 weight percent.

21. The lubricant of any of embodiments 1 through 20 wherein the total amount of polymer (b) plus polymer (c) is 10 to 50 or to 55 percent by weight (or 20 to 50 or 10 to 25 or 25 to 50 or 25 to 40 percent by weight) of the lubricating composition.

22. The lubricant of any of embodiments 1 through 21 further comprising at least one of a detergent, a dispersant, an antioxidant, an additional viscosity improver, an antiwear agent, and anti-scuffing agent, an extreme-pressure agent, a corrosion inhibitor, a foam inhibitor, a pour point depressant, or a friction modifier.

23. The lubricant of any of embodiments 1 through 22 wherein the lubricant contains 0.01 to 1 weight percent sulfur and 0.005 to 0.1 weight percent phosphorus.

24. A process for preparing a lubricating composition, said process comprising:

(A) forming an esterified copolymer comprising (1) reacting (i) an alpha-olefin of at least about 6 carbon atoms and (ii) an ethylenically unsaturated carboxylic acid or derivative thereof, to form a copolymer; wherein the mole ratio of (i) α-olefin monomer to (ii) carboxylic acid or derivative monomer is 1:3 to 3:1;

(2) esterifying the copolymer of step (1) to form an esterified copolymer; and (3) optionally reacting the copolymer of step (2) with a nitrogen-containing compound in an amount to provide an esterified copolymer with at least 0.01 weight percent nitrogen; and (B) mixing the esterified copolymer from (A) with (i) an oil of lubricating viscosity having a kinematic viscosity at 100° C. of less than about 15 $mm^2/s$ and (ii) a polymer comprising olefin monomer units of at least 3 carbon atoms, wherein at least 50 percent by weight of such units contain fewer than 6 carbon atoms and wherein less than 5 percent by weight of the monomer units are ethylene monomer units; said polymer (ii) having a kinematic viscosity at 100° C. of at least 1000 $mm^2/s$;

wherein the polymers of (A)) and (B)(ii) are present in a weight ratio (A):(B)(ii) of 1:10 to 10:1 and wherein the total amount of polymer (A) plus (B)(ii) is 3 to 60 percent by weight of the lubricant composition.

25. A process for preparing a lubricating composition, said process comprising:

(A) forming an esterified copolymer comprising (1) reacting (i) an alpha-olefin of at least about 6 carbon atoms and (ii) an ester of an ethylenically unsaturated carboxylic acid, to form a copolymer; wherein the mole ratio of (i) α-olefin monomer to (ii) ester of unsaturated carboxylic acid is 1:3 to 3:1;

(2) optionally reacting the copolymer of step (1) with a nitrogen-containing compound in an amount to provide an esterified copolymer with at least 0.01 weight percent nitrogen; and (B) mixing the esterified copolymer from (A) with (i) an oil of lubricating viscosity having a kinematic viscosity at 100° C. of less than 15 $mm^2/s$ and (ii) a polymer comprising olefin monomer units of at least 3 carbon atoms, wherein at least 50 percent by weight of such units contain fewer than 6 carbon atoms and wherein less than 5 percent by weight of the monomer units are ethylene monomer units; said polymer (ii) having a kinematic viscosity at 100° C. of at least about $mm^2/s$;

wherein the polymers of (A) and (B)(ii) are present in a weight ratio (A):(B)(ii) of 1:10 to 10:1 and wherein the total amount of polymer (A) plus (B)(ii) is 3 to 60 percent by weight of the lubricant composition.

26. A lubricant composition prepared by the process of embodiment 24 or embodiment 25.

27. A method for lubricating a mechanical device, comprising supplying thereto the lubricant of any of embodiments 1 to 22 or embodiment 26.

28. The method of embodiment 27 wherein the mechanical device comprises a hypoid gear.

29. The method of embodiment 27 or embodiment 28 wherein the mechanical device comprises a component of a driveline system of a vehicle.

30. The use of the lubricating composition of any of embodiments 1 to 22 or embodiment 26 to lubricate a driveline system of an automotive vehicle.

31. A lubricant composition comprising (a) an oil of lubricating viscosity having a kinematic viscosity at 100° C. of less than about 15 $mm^2/s$ and (b) an esterified copolymer with a backbone comprising units derived from (i) an α-olefin monomer of at least about 6 carbon atoms and (ii) an ethylenically unsaturated carboxylic acid or derivative thereof, wherein the mole ratio of (i) α-olefin monomer to (ii) carboxylic acid or derivative monomer is about 1:3 to about 3:1, said copolymer optionally containing nitrogen functionality; and (c) a polymer comprising olefin monomer units of at least 3 carbon atoms, wherein at least 50 percent by weight of such units contain fewer than 6 carbon atoms and wherein less than 5 percent by weight of the monomer units are ethylene monomer units; said polymer having a kinematic viscosity at 100° C. of at least about 250 or about 500 or about 800 or about 1000 $mm^2/s$;

wherein the polymers (b) and (c) are present in a weight ratio (b):(c) of about 1:10 to about 10:1 or about 1:1 to about 10:1 or about 6:4 to about 9:1 and wherein the total amount of polymer (b) plus (c) is about 3 to about 60 percent by weight of the lubricant composition, and embodiments 2-30 above may each also be based on said lubricant.

The invention claimed is:

1. A lubricant composition comprising (a) about 16 to about 84.5 percent by weight of an oil of lubricating viscosity having a kinematic viscosity at 100° C. of less than about 15 $mm^2/s$ which comprises a poly-α-olefin; and (b) about 12 to about 44 percent by weight of an esterified copolymer having a weight average molecular weight of about 5,000 to about 30,000, with a backbone comprising units derived from (i) an α-olefin monomer of at least about 10 to about 14 carbon atoms and (ii) maleic anhydride or derivative thereof, wherein the mole ratio of (i) α-olefin monomer to (ii) maleic anhydride or derivative thereof is about 0.8:1 to about 1.1:1, said copolymer further containing nitrogen functionality derived from reaction of said copolymer with an amine which comprises an imidazolidinone, said copolymer containing about 0.075 to about 0.25 weight percent nitrogen; and (c) about 0.3 to about 25 percent by weight of a polyisobutene having a kinematic viscosity at 100° C. of at least about 1000 $mm^2/s$ and a weight average molecular weight of about 1,000 to about 3,000;

wherein the polymers (b) and (c) are present in a weight ratio (b):(c) of about 6:4 to about 9:1 and wherein the total amount of polymer (b) plus (c) is about 25 to about 50 percent by weight of the lubricant composition.

2. The lubricant composition of claim 1 wherein the backbone of copolymer (b) further comprises units of a vinyl aromatic monomer.

3. The lubricant of claim 1 further comprising at least one of a detergent, a dispersant, an antioxidant, an additional viscosity improver, an antiwear agent, an anti-scuffing agent, an extreme-pressure agent, a corrosion inhibitor, a foam inhibitor, a pour point depressant, or a friction modifier.

4. The lubricant of claim 1 wherein the lubricant contains 0.01 to 1 weight percent sulfur and 0.005 to 0.1 weight percent phosphorus.

5. A method for lubricating a mechanical device, comprising supplying thereto the lubricant of claim 1.

6. The method of claim 5 wherein the mechanical device comprises a hypoid gear.

7. The method of claim 5 wherein the mechanical device comprises a component of a driveline system of a vehicle.

8. The lubricant composition of claim 1 wherein the oil of lubricating viscosity consists essentially of a poly-α-olefin.

* * * * *